United States Patent [19]

Bertiller

[11] Patent Number: 4,620,485

[45] Date of Patent: Nov. 4, 1986

[54] TRAINING CARTRIDGE

[75] Inventor: Roland Bertiller, Schramberg, Fed. Rep. of Germany

[73] Assignee: Mauser-Werke Oberndorf GmbH, Fed. Rep. of Germany

[21] Appl. No.: 667,546

[22] Filed: Nov. 2, 1984

[30] Foreign Application Priority Data

Nov. 3, 1983 [DE] Fed. Rep. of Germany ..... 3339745

[51] Int. Cl.[4] ..... F42B 5/22

[52] U.S. Cl. ..... 102/444; 102/446; 102/447; 102/430; 102/204; 102/235

[58] Field of Search ..... 102/444, 446, 447, 204, 102/430, 221, 235

[56] References Cited

U.S. PATENT DOCUMENTS

| | | | |
|---|---|---|---|
| 2,322,212 | 6/1943 | Allen | 102/445 X |
| 4,088,056 | 5/1978 | Dallaire | 102/444 X |
| 4,195,575 | 4/1980 | Deuker et al. | 102/235 X |
| 4,218,976 | 8/1980 | Luebbers | 102/445 X |
| 4,430,940 | 2/1984 | Jermunson | 102/446 |
| 4,442,777 | 4/1984 | Greene | 102/444 |
| 4,454,816 | 6/1984 | Billard et al. | 102/430 |
| 4,457,204 | 7/1984 | Blomgren | 102/204 X |

FOREIGN PATENT DOCUMENTS

| | | | |
|---|---|---|---|
| 68532 | 1/1983 | European Pat. Off. | 102/444 |

*Primary Examiner*—Peter A. Nelson
*Attorney, Agent, or Firm*—McGlew and Tuttle

[57] ABSTRACT

An adaptation cartridge comprises a firing pin casing which is screwed into a cartridge chamber or cartridge chamber tube and is secured against rotation by a radially displaceable slide. The cartridge is used for training on a gun having a subcaliber barrel adapter.

15 Claims, 4 Drawing Figures

TRAINING CARTRIDGE

FIELD AND BACKGROUND OF THE INVENTION

The present invention relates in general to cartridges for guns, and in particular to a new and useful adaptation cartridge for an adapter barrel system for the firing of subcaliber ammunition from a gun barrel of larger caliber, with a centrally inserted cartridge chamber and a firing pin casing axially following the chamber.

An adaptation cartridge which, as to form and weight, corresponds to an original cartridge of live ammunition is used for training purposes, and is received centrally in a cartridge chamber for a subcaliber ammunition. The firing pin casing of such cartridges serves as transmission element for detonating the cartridge and at the same time as a supporting element for absorption of gas pressure generated in the gun. This means that the firing pin casing takes support on the end side on the breech mechanism of the weapon, e.g. an armor-piercing gun. When closing the breech mechanism, the axially displaceable firing pin casing is pushed forward to the cartridge chamber and thus unlocks the firing pin centrally inserted in the casing. Since after firing a residual stress remains in the adapter barrel system, the firing pin casing is pressed axially against the breech mechanism with great force due to the expansion of the cartridge. The disadvantage of this is that for opening the breech to remove the empty cartridge case, much force must be exerted, and this in turn leads to ejection problems.

SUMMARY OF THE INVENTION

It is an object of the present invention therefore, to provide an adaptation cartridge of the above-mentioned kind which ensures satisfactory and realistic functioning with proper ejection of the adaptation cartridge and adequate safety.

According to the invention, this problem is solved in that the firing pin casing is inserted centrally into the cartridge chamber and is connected mechanically and/or dynamically with the cartridge chamber on the breech side and further comprises means for safety against axial and radial displacement as well as of the firing pin. In a technically equivalent design, the firing pin casing may be inserted centrally in a cartridge chamber tube and be mechanically and/or dynamically connected to the cartridge chamber tube, which by its front end is firmly connected to the cartridge chamber and takes support on the adaptation cartridge axially on the breech side. The advantage of an adaptation cartridge for adapter barrel systems designed in this original manner is that it is well suitable for training purposes and is laid out so that all forces occurring during firing are absorbed within the adaptation cartridge. While in the described state of the art cartridges, the breech mechanism jams badly due to the bracing of the ammunition on the breech and can be opened only with great force, with the cartridge according to the invention no clamping whatever occurs. Cartridge ejection can take place easily and no disturbance occur. For the operator this means great safety combined with easy handling. In addition, the invention makes possible a training bombardment in the required time.

In a variant of the invention, the firing pin casing may be connected to the cartridge chamber or cartridge chamber tube on the breech side by a trapezoidal thread. Besides safety, this makes it especially easy to load the adaptation cartridge with the subcaliber ammunition. Advantageously the trapezoidal thread is designed so that it is self-locking during bombardment, but is easy to unscrew for disassembly.

As a further variant, the breech-side end wall of the firing pin casing may have provided in at least one off-center bore in which is inserted an axially displaceable joint which is in operative connection with a slide radially displaceable in a safety slit in the cartridge chamber or cartridge chamber tube, which slide is held in safe position by a spring.

The joint can embrace a cross-bolt, which is passed through a cross-slot in the slide, the slot slanting outward from the plane of the longitudinal axis of the blind bore.

Further a second off-center blind bore may be provided in the breech side end wall of the firing pin casing, in which bore an axially displaceable joint is inserted which is in operative connection with a slide radially displaceable in a recess in the firing pin, which slide is held in safe position by a spring.

These aforesaid features relate to advantageous designs for safety against radial and axial displacement of the firing pin casing and of the firing pin. The safety device engages whenever the striking pin casing is inserted into the adaptation cartridge. Release of the safety device is possible only with a tool to be introduced into the blind bore from the outside, in that the joint is displaced axially inward, thereby retracting the slide radially from the safety slit.

Accordingly, a further object of the invention is to provide an adaptation cartridge for an adaptor barrel system for firing subcaliber ammunition through a gun barrel of larger caliber, comprising a cartridge chamber for carrying the subcaliber ammunition, a firing pin casing centrally inserted in the cartridge chamber and connected to the cartridge chamber and means near the breech end of the adaptation cartridge for axially and radially fixing the firing pin case with respect to the cartridge chamber.

A further object of the present invention is to provide such an adaptation cartridge wherein the safety means comprises at least one off center blind bore in the firing pin casing, a joint movably mounted in the blind bore and a slide movable radially with axial movement of the joint for engaging and disengaging a locking safety slot to prevent relative rotation between the casing and the cartridge chamber.

A still further object of the invention is to provide an adaptation cartridge which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

An example of the invention is illustrated in the drawings, wherein.

DESCRIPTION OF THE PREFERRED EMBODIMENT

Figure 1:
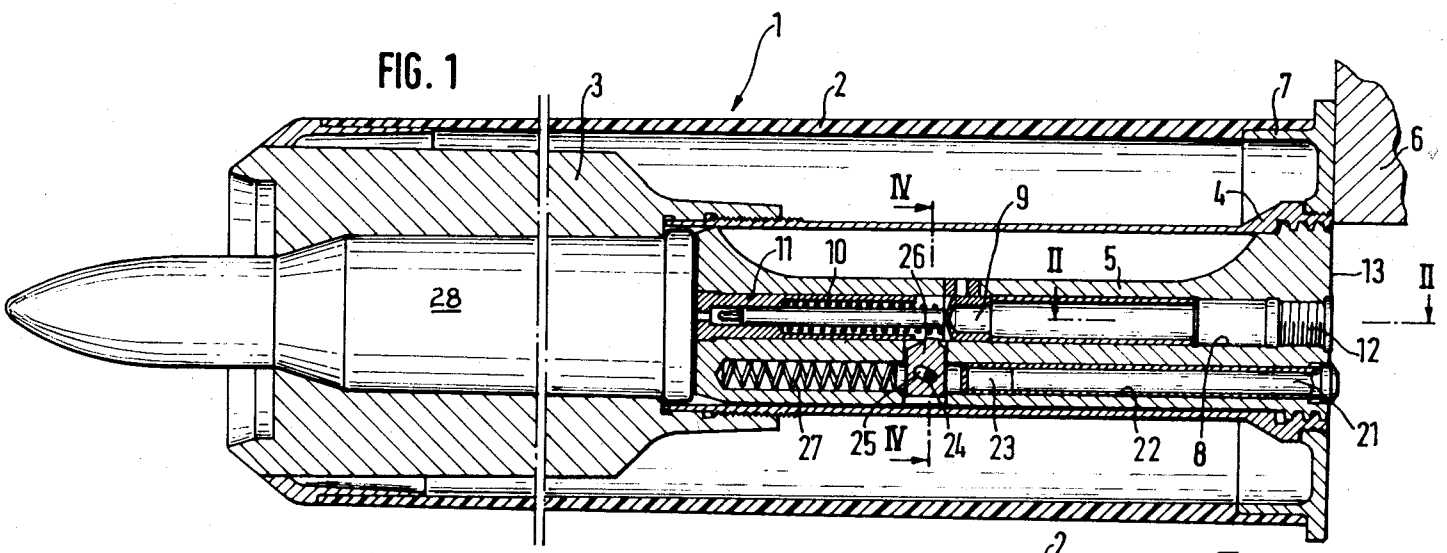
FIG. 1 is a longitudinal sectional view of the adaptation cartridge.

The inventive adaptation cartridge 1 consists essentially of a tubular jacket 2, a cartridge chamber 3, a cartridge chamber tube 4, and a firing pin casing 5.

Figure 2:
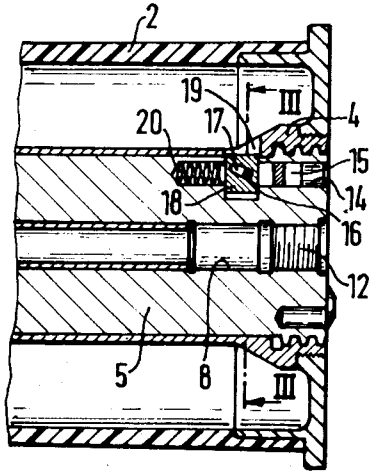
FIG. 2 is a sectional view of the anti-displacement and anti-rotation device of the striking pin casing of the invention, taken along line II—II of FIG. 1.
Figure 3:
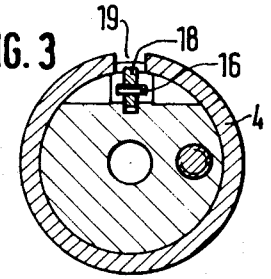
FIG. 3 is a sectional view of a safety device taken along ling III—III of FIG. 2.
Figure 4:
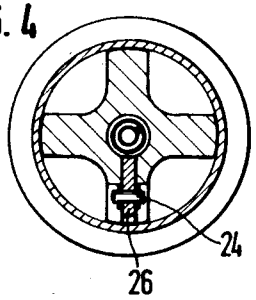
FIG. 4 is a sectional view of the striking pin lock taken along line IV—IV of FIG. 1.

The cartridge chamber 3 is arranged to be centered in jacket 2 of the adaptation cartridge, with the cartridge chamber tube 4 following the cartridge chamber 3 toward the breech mechanism 6 of a gun (not shown) in coaxial arrangement. Tube 4 may be on a one piece extension of the cartridge chamber 3. In the example shown in FIG. 1 it is a separate part, connected to the cartridge chamber 3 mechanically and dynamically, e.g. by threading, welding or pressing. The cartridge chamber tube 4 takes support axially at the breech side end on a flanged ring 7 of the adaptation cartridge 1. The firing pin case 5 has a central bore 8, in which a firing pin 9 and firing pin spring 10 are inserted in an intermediate sleeve 11. At the breech side end, bore 8 has a thread bore 12 to which a tool can be screwed. The thread serves at the same time to receive an assembling tool, as will be described later. In the rear end wall 13 of the firing pin casing 5 an off-center blind bore 14 is cut (FIG. 2). Inserted in the blind bore is a fork-like joint 15, whose arms embrace a cross-bolt 16. Bolt 16 is fitted in a cross-bore 17 in a slide 18 which is radially displaceable and engages in a safety slit 19 of the firing pin casing 5. The cross-bore 17 in slide 18 starts from the plane of the longitudinal axis of the blind bore 14 and slants radially outward. A spring 20 which is supported on the end of the blind bore 14, bears against the slide 18. The protection of the firing pin casing 5 against rotating thus occurs through slide 18 engaging into the safety slit 19 of the cartridge chamber tube 4.

Casing 5 is threaded into tube 4 and the tightening of casing 5 into cartridge chamber tube 4 is done by a tool (not shown) which is screwed into the firing pin bore 12 and which protrudes into the blind bore 14 by a tenon. The screwing in of the tool causes axial penetration of the tool tenon into the blind bore 14 against the joint 15. Joint 15 pushes bolt 16 forwardly and thereby the slide 18 moves radially inwardly due to the action of bolt 16 in bore 17. Slide 18 thus is pulled inwardly out of slit 19 while the firing pin casing 5 is being screwed into the cartridge chamber tube 4. In the end position and when the tool tenon is removed, bolt 16 moves back in the cross-bore 17 and thereby causes the slide 18 to come out radially into the safety slit 19 due to the force of spring 20.

The slide 18 is now held in this safe position by the joint 15 as well as the spring 20. Unlocking of case 5 can again occur only with the tool, by which the tenon is pushed into the blind bore 14 against the joint 15 and the latter is displaced axially. Thereby the bolt 16 is moved in the control slot or bore 17 and the slide 18 is retracted out of the safety slit 19 radially.

Locking of the firing pin 9 occurs in a similar manner. Here the unlocking is done by way of a locking rod 21 in a second off center blind bore 22 in the firing pin casing 5. The locking rod 21 presses axially against a fork-like joint 23, which in turn extracts a slide 26 radially from a recess in the firing pin 9 by way of a bolt 24 in an oblique slot 25. Slide 26 is again held in safe position in the blind bore 22 by a compression spring 27. A subcaliber cartridge 28 is shown in the cartridge chamber 3.

In operation, the adapatation cartridge 1 is seated in the large caliber gun with the adapted barrel which is adapted to the diameter of the projectile of cartridge 28. Loading rod 21 has a projection shown in FIG. 1 which extends beyond the breech end face 13. With adaptation cartridge 1 seated in the gun, this projection forces rod 21 forwardly (toward cartridge 28) against the bias of spring 27. This moves slide 26 radially outwardly to permit the forward movement of firing pin 9. When firing the gun, the firing pin of the gun (not shown) can thus strike firing pin 9 which in turn fires cartridge 28.

While a specific embodiment of the invention has been shown and described in detail to illustrate the application of the principles of the invention, it will be understood that the invention may be embodied otherwise without departing from such principles.

What is claimed is:

1. An adaptation cartridge for firing subcaliber ammunition from a gun having a breech mechanism for receiving the adaptation cartridge and and adapted barrel for receiving a projectile of the subcaliber ammunition, comprising:

a cartridge chamber for receiving the subcaliber ammunition and for being centrally engaged against the breech mechanism;

a firing pin casing centrally engaged in said cartridge chamber from an end of said cartridge chamber adapted to face the breech mechanism, said firing pin casing having a firing pin bore;

a firing pin movable in said firing pin bore for firing the subcaliber ammunition received in said cartridge chamber;

first safety means connected between said firing pin casing and said cartridge chamber for preventing relative axial and relative radial movement therebetween; and second safety means connected in said firing pin casing for blocking movement of said firing pin into a position to ignite subcaliber ammunition received in said cartridge chamber.

2. An adaptation cartridge according to claim 1, wherein said cartridge chamber includes a cartridge chamber tube for extending toward the breech mechanism, said tube defining a space, said firing pin casing being connected to said tube and disposed in said space, said adaptation cartridge including a jacket surrounding said cartridge chamber and a flange adapted to be disposed adjacent the breech mechanism and connected between said jacket and said tube for holding said tube in an axially fixed position with respect to said jacket.

3. An adaptation cartridge according to claim 1, wherein said first safety means includes a trapezoidal thread defined in said cartridge chamber and a trapezoidal thread defined on said firing pin casing threaded with said trapezoidal thread of said cartridge chamber for holding said casing at an axially fixed location with respect to said chamber.

4. An adaptation cartridge according to claim 2, wherein said first safety means includes a trapezoidal thread defined in said cartridge chamber tube and a trapezoidal thread defined on said firing pin casing threaded with said trapezoidal thread of said cartridge chamber tube for holding said casing at an axially fixed location with respect to said tube.

5. An adaptation cartridge according to claim 1, wherein said firing pin casing has a breech side end wall, said first safety means including a first off-center blind-bore extending axially into said casing from said end wall, a joint displaceable in said blind-bore, a slide radially movable in said casing and engaged with said joint for radial movement with axial movement of said joint, said cartridge casing including a safety slit, said slide being movable into said safety slit for preventing relative rotation between said cartridge and said casing, and movable out of said slit with axial movement of said joint for permitting relative rotation between said chamber and casing, and a spring engaged against said slide for biasing said slide into said safety slit.

6. An adaptation cartridge according to claim 2, wherein said firing pin casing has a breech side end wall, said first safety means including a first off-center blind-bore extending axially into said casing from said end wall, a joint displaceable in said blind-bore, a slide radially movable in said casing and engaged with said joint for radial movement with axial movement of said joint, said cartridge casing tube including a safety slit, said slide being movable into said safety slit for preventing relative rotation between said cartridge and said casing, and movable out of said slit with axial movement of said joint for permitting relative rotation between said chamber and casing, and a spring engaged against said slide for biasing said slide into said safety slit.

7. An adaptation cartridge according to claim 5 wherein said first safety means further includes a bolt connected to said joint, said slide having a cross slot therein inclined with respect to an axis of said casing, said bolt disposed in said slot for moving said slide radially with axial movement of said joint.

8. An adaptation cartridge according to claim 6, wherein said first safety means further includes a bolt connected to said joint, said slide having a cross slot therein inclined with respect to an axis of said casing, said bolt disposed in said slot for moving said slide radially with axial movement of said joint.

9. An adaptation cartridge according to claim 1, wherein said firing pin casing includes a breech side end wall, said second safety means including a second off-center blind-bore extending axially into said casing from said end wall, a joint axially movable in said blind bore, a slide radially movable in said firing pin casing and engaged with said joint for radial movement with axial movement of said joint, and a spring biasing said slide into a radial position blocking movement of said firing pin, said firing pin bore communicating with an opening containing said slide.

10. An adaptation cartridge according to claim 7, wherein said second safety means comprises a second off-center blind bore extending axially into said firing pin casing from said end wall, a second joint axially displaceable in said second blind bore, a second slide radially movable in said casing into a position for blocking movement of said firing pin, said second slide engaged with said second joint for radial movement with axial movement of said second joint and a second spring engaged with said second slide for moving said second slide into a position for blocking movement of said firing pin.

11. An adaptation cartridge according to claim 10, including a locking rod connected to said second slide having an end projecting beyond said end wall whereby with said adaptation cartridge seated in the breech mechanism, said locking rod is moved into a position for retracting said second slide from blocking movement of said firing pin.

12. An adaptation cartridge according to claim 11, wherein each of said first mentioned and second slides includes a slot inclined at an angle with respect to an axis of said casing, and a bolt connected to each of said first mentioned and second joint, and engaged into said slot of said first mentioned and second slides repectively.

13. An adaptation cartridge for an adapter barrel system and for firing subcaliber ammunition from a gun barrel of larger caliber, comprising:

a cartridge chamber (3);

a firing pin casing (5) centrally and axially engaged with said cartridge chamber, said firing pin casing being connected at least one of mechanically and dynamically to said said cartridge chamber on a breech side thereof;

first safety means connected between said chamber and casing for safety against axial and radial displacement therebetween, and second safety means for maintaining a firing pin (9) in said casing against firing.

14. An adaptation cartridge according to claim 13, wherein said first safety means comprises a first off-center bore in said casing, a first joint movable in said first off-center bore and a slide radially movable in said casing and engaged with said joint for radial movement with axial movement of said joint, a safety slot in said cartridge chamber engageable by said slide for blocking relative rotation between said casing and said chamber, said second safety means comprising a second off-center bore in said casing, a second joint movably mounted in said second off-center bore and a second slide mounted for radial movement in said casing and engaged with said second joint for movement into and out of a position blocking movement of said firing pin.

15. An adaptation cartridge according to claim 14, wherein said cartridge chamber includes a tube extending toward a breech end of said casing, said casing threadably engaged in said tube, a tubular jacket surrounding said cartridge chamber with its tube and a flange extending radially from said jacket to said tube for holding said tube in an axially and in a radially fixed position with respect to said jacket.

* * * * *